US006086084A

United States Patent [19]

Wemmenhove

[11] Patent Number: 6,086,084

[45] Date of Patent: Jul. 11, 2000

[54] REINFORCED ELONGATE METAL BODY

[75] Inventor: Geert Wemmenhove, Nijverdal, Netherlands

[73] Assignee: Hunter Douglas Industries B.V., Rotterdam, Netherlands

[21] Appl. No.: 08/973,358

[22] PCT Filed: Mar. 6, 1996

[86] PCT No.: PCT/NL96/00217

§ 371 Date: Mar. 6, 1998

§ 102(e) Date: Mar. 6, 1998

[87] PCT Pub. No.: WO96/38209

PCT Pub. Date: Dec. 5, 1996

[30] Foreign Application Priority Data

Jun. 2, 1995 [NL] Netherlands ..... 1000493

[51] Int. Cl.[7] ..... A63C 5/07

[52] U.S. Cl. ..... 280/602; 280/11.17; 280/11.18; 280/11.19; 280/819; 273/80

[58] Field of Search ..... 280/602, 11.17–11.19, 280/819; 273/80

[56] References Cited

U.S. PATENT DOCUMENTS

| | | | |
|---|---|---|---|
| 1,459,050 | 6/1923 | Drevitson . | |
| 3,212,786 | 10/1965 | Florjancic et al. | 280/11.12 |
| 3,300,226 | 1/1967 | Reed | 280/11.13 |
| 3,349,537 | 10/1967 | Hopfeld | 52/729 |
| 3,487,518 | 1/1970 | Hopfeld | 29/155 |
| 3,894,745 | 7/1975 | Heim et al. | 280/11.13 |
| 3,972,529 | 8/1976 | McNeil | 273/80 |
| 4,221,400 | 9/1980 | Powers | 280/602 |

FOREIGN PATENT DOCUMENTS

| | | |
|---|---|---|
| 0056288 | 7/1982 | European Pat. Off. . |
| 0211389 | 2/1987 | European Pat. Off. . |
| 0685611 | 12/1995 | European Pat. Off. . |
| 1548662 | 10/1968 | France . |
| 1139260 | 11/1962 | Germany . |
| 2021347 | 11/1970 | Germany . |
| 1945781 | 3/1971 | Germany . |
| 2547897 | 5/1977 | Germany . |
| 3017336 | 11/1981 | Germany . |
| 3528307 | 2/1987 | Germany . |
| 4408444 | 4/1995 | Germany . |
| 9000088 | 8/1991 | Netherlands . |
| 8805324 | 7/1988 | WIPO . |
| 9216347 | 10/1992 | WIPO . |
| 9534352 | 12/1995 | WIPO . |
| 9605240 | 2/1996 | WIPO . |

*Primary Examiner*—Brian L. Johnson
*Assistant Examiner*—Deanne Draper
*Attorney, Agent, or Firm*—Webb Ziesenheim Logsdon Orkin & Hanson, P.C.

[57] ABSTRACT

The invention relates to an elongate metal body, for instance an aluminium rod with a chosen cross-sectional form manufactured by extrusion. It is a first object of the invention to make an elongate metal body stiffer and stronger without this entailing an increase in weight. In respect of this objective the metal body according to the invention has the feature that the body has at least one cavity extending at least to a considerable degree in longitudinal direction, in which cavity is received a pre-manufactured elongate reinforcing rod, of which at least the ends are coupled to the body in force-transmitting manner.

42 Claims, 12 Drawing Sheets

19
13
22
18
29
21
26
17
25
24
23
20
16
11
14
15
12
5

REINFORCED ELONGATE METAL BODY

BACKGROUND OF THE INVENTION

1. Field of the Invention

The invention relates to an elongate metal body, for instance an aluminium rod with a chosen cross-sectional form manufactured by extrusion.

2. Background Information

Such a body is known in many applications. A well-known application is a skate frame for an ice-skate or roller-skate. Such a frame comprises for instance an elongate carrier manufactured from aluminium by means of extrusion, to which the runner or wheels are connected.

SUMMARY OF THE INVENTION

It is a first object of the invention to make an elongate metal body stiffer and stronger without this entailing an increase in weight. In respect of this objective the metal body according to the invention has the feature that the body has at least one cavity extending at least to a considerable degree in longitudinal direction, in which cavity is received a pre-manufactured elongate reinforcing rod, of which at least the ends are coupled to the body in force-transmitting manner.

The embodiment is recommended in which the rod consists substantially of a bundle of longitudinally extending, continuous fibres embedded in a plastic matrix, in particular consisting of carbon, aramid, glass, boron, reinforced polyethylene and other synthetic and ceramic materials. Such a rod of composite material combines a very great longitudinal strength with a low weight.

A very simple and inexpensive embodiment is that in which the rod is connected to the body by glue.

For strengthening and reinforcement this variant can have the special feature that the rod is connected substantially along its whole outer surface to the body.

A further variant is characterized by biasing means for holding the rod under longitudinal bias.

For particular applications this variant can have the special feature that the biasing means are adjustable.

A specific embodiment hereof has the feature that the biasing means comprise screw means.

The biasing means can be embodied such that the rod fits into the cavity with small clearance and the biasing means are adapted to exert a pressure force on the ends of the rod.

An embodiment with optionally adjustable biasing means can have the special feature that the cavity is positioned at a distance from the neutral fibre of the body. The metal body comes under strain of bending due to the longitudinal force exerted at a distance from the neutral fibre. A bending can thus be obtained which, in the case of adjustable biasing means, can be adjusted to a desired value.

This latter embodiment in particular can, as will be described hereinbelow, be important for application in the skating sport. This is the case however for the invention in general. The invention therefore also pertains to a skate frame for an ice-skate or roller-skate which is provided with an elongate metal body having connected thereto an elongate reinforcing rod as specified above.

A runner for an ice-skate is generally ground with a determined radius of curvature. This radius of curvature is arranged in the height direction of the skate.

In the case of short-track skating and 500 metre sprint skating on the track it is at the moment usual for the skates also to have a certain curvature in sideways direction. The value thereof, which can be expressed in the radius of curvature, is greatly dependent on personal wishes and preferences. At the moment the skate frame is herein usually clamped in a vice, wherein a part of the skate is bent manually. The object of this bending operation is to obtain a better grip on the ice in the bend, whereby the skater can negotiate the bend at an even greater angle and speed without the risk of slipping.

As has been stated, the value of the radius of curvature to be adjusted is very person-dependent. The degree of bending must moreover be adapted to the ice conditions, so that there is a need for an adjustable bending.

For the purpose of grinding the runner it is further desirable that the skate is straight or can be straightened when not in use, so that the runner can be clamped into usual grinding devices. It is therefore desirable that the runner can be straightened again with simple means.

The above described steps according to the invention, for instance biasing means adjustable by means of screw means, obviate the above described problem.

Due to the combination of materials with different coefficients of expansion there occurs a difference in expansion or shrink of the materials in the case of temperature changes. For instance in the combination of an aluminium frame in which a steel runner is arranged, the following phenomenon occurs. A radius in the runner of for instance 20 metres at room temperature will have a radius of curvature at minus 15° C. of about 17 metres. This temperature-dependent radius of curvature is undesirable if it does not correspond to the radius of curvature desired at these temperatures. There therefore exists a need to change the effective coefficient of expansion, locally or otherwise, of an aluminium skate frame in order to thus make it possible to compensate for the deformation due to temperature differences.

The stiffness of a skate frame is also of great importance. Due to the great forces during starting, sprinting and taking of a bend, the skate and the frame have a tendency to deform. This deformation must be limited to a minimum. If a skate is subjected to bending, a small radius of curvature must be arranged in advance both in height and in sideways direction in order to still have the correct radius of curvature in the bend. This has the disagreeable consequence that the straight part of the skate track must be skated with a small radius of curvature, which adversely affects the speed. For these reasons there therefore exists a need for a stiff skate frame.

This need for more stiffness and strength also exists in other constructions, such as for instance in aluminium boat masts, booms and the like. Other applications relate to ladders, for instance fire ladders, aluminium profiles in the building industry, glasshouse construction etc. Supporting aluminium profiles also often have the limitation of insufficient stiffness and strength. The invention provides a solution herefor.

It is noted that particularly the biasing means according to the invention can cause a bending in two directions. For this purpose two push or pull rods are then connected to the profile, this at mutually differing positions relative to the neutral fibre, for instance such that the one rod causes a sideward bending and the other rod a bending in vertical direction.

By arranging carbon rods in the outer wall of a skate frame the stiffness is improved to a significant extent. Carbon fibres have a stiffness which is a factor 3–6 times higher than that of aluminium, while the specific mass amounts to about half thereof. The strength of carbon is 4–10 times that of aluminium. The structure of the elongate metal body can thus be lighter while retaining strength and stiffness.

Another advantage of carbon fibres is that these fibres display a fully elastic behaviour. This in contrast to for instance the aluminium, where the elasticity limit is relatively low and a permanent plastic deformation occurs quite rapidly when there is load. The stiff and strong carbon fibres prevent this plastic deformation of the aluminium.

The reinforcing rod which according to the invention is added to the elongate metal body has in the most general sense better properties than the material of the metal body itself, particularly in respect of strength and stiffness. The gluing of the rod into the cavity takes place for instance with an epoxy glue. Aluminium bodies are preferably anodized with usual methods to thus obtain a suitable gluing surface. Other cleaning and surface treatments, such as for instance chrome-plating, can be used.

A reinforcing rod can have a desired cross-sectional form, for instance a round form or can have another cross section adapted to the geometry of the cavity or the metal body, for instance square, rectangular, polygonal.

The cavity can for instance be arranged completely internally in the body. A cavity can also be partially open to the outside in longitudinal direction, which simplifies the extrusion process for manufacturing the metal body. The opening of such semi-open forms can be situated on the inside or the outside of the profile. In this latter case the reinforcing rod is partly visible on the outside.

In the case of an enclosed cavity in a metal body a reinforcing rod, which is for instance obtained via a pull-trusion process, is pushed into the cavity. The glue can herein be pre-applied to the rod and/or in the cavity.

Another method is to insert the rod into the cavity without glue. By supplying glue to the one open side and sucking on the other side of the cavity (in which the rod is received), the glue can be applied between the wall of the cavity and the reinforcing rod so that it wholly fills the remaining space.

BRIEF DESCRIPTION OF THE DRAWINGS

Further characteristics and special features of the invention will now be elucidated with reference to the annexed drawings. Herein.

DESCRIPTION OF THE PREFERRED EMBODIMENTS

Figure 1:
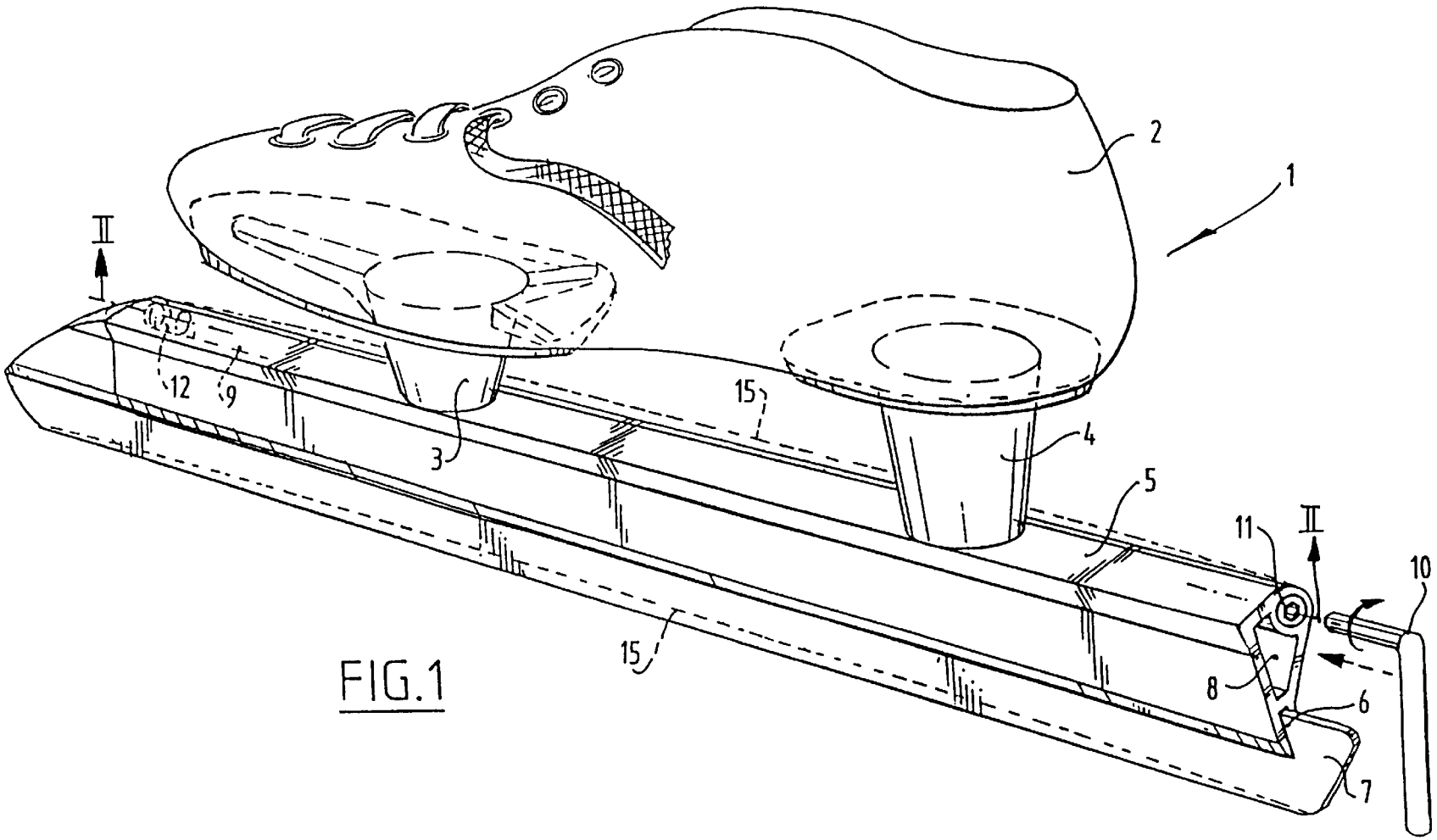
FIG. 1 is a schematic perspective view of a skate with a frame according to the invention.

FIG. 1 shows an ice-skate 1. This comprises a shoe 2, a sole support 3 connected to the sole thereof and a heel support 4 connected to the heel. Connected to these supports 3 and 4 is an extruded aluminium profile 5, on the underside of which a runner 7 is glued into a groove 6. The profile 5 shows a downward tapering form and is provided with two cavities respectively 8 and 9 extending in longitudinal direction. The relatively large cavity 8 has the function of reducing the weight of profile 5. The cavity 9 has a cylindrical form in this embodiment. Arranged with small clearance in this cavity 9 is a reinforcing rod consisting of a bundle of continuous carbon fibres extending in longitudinal direction and embedded in a plastic matrix. At both ends of cavity 9 a screw thread is tapped in the wall thereof, into which are placed screws 11, 12 which are operable from outside by means of a tool 10. The screws engage for pressing on the carbon rod 13 in the manner shown in FIG. 2. By rotating the tool 10 as according to arrow 14 the pressure force exerted on rod 13 is increased, whereby as a result of the relatively great pressure strength of this rod 13 relative to the aluminium of the profile 5 this latter is subjected to a bending which is indicated with the dash-dot line 15. The profile and the runner 7 hereby acquire a bent form, the radius of curvature of which is adjustable.

FIGS. 3, 4, 5 and 6 show respectively frames 16, 17, 18, 19 in which the reinforcing rods 13 are arranged. Frames 17, 18, 19 have additional reinforcing rods 20, 21, 22 respectively.

Figures 2, 3, 4, 5, 6:
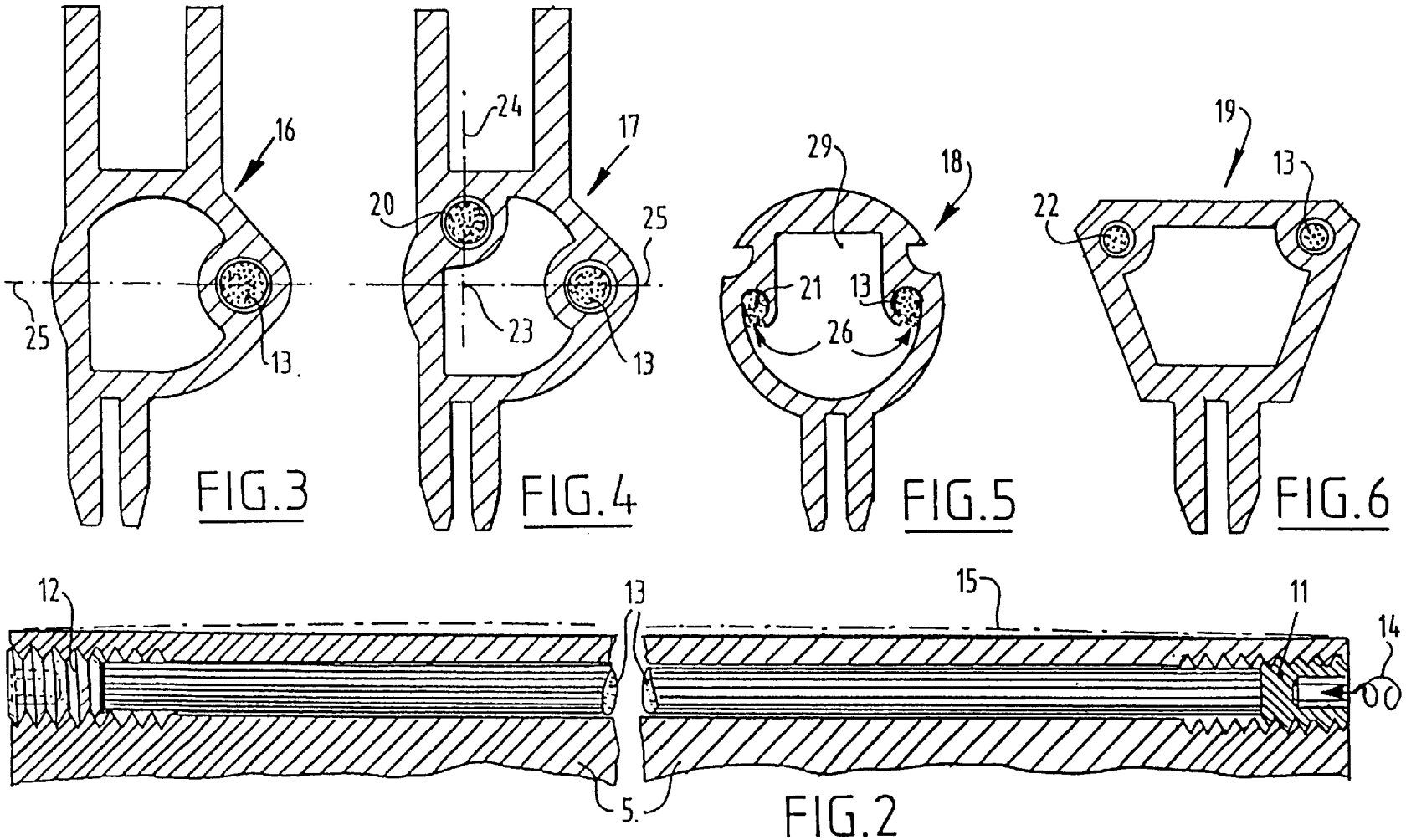
FIG. 2 shows the cross section II—II according to FIG. 1 on enlarged scale.
FIGS. 3, 4, 5 and 6 show cross sections through alternative profiled rods embodied as skate frames.

For instance the embodiment according to FIG. 4 offers the possibility of influencing the curvature in the horizontal plane as well as that in the vertical plane. The rod 13 can influence the horizontal curvature in the same manner as described with reference to FIGS. 1 and 2, while the rod 20 influences the curvature in the vertical plane. This embodiment is such that the neutral fibre 23 of the structure is situated at the point of intersection of the vertical plane 24 through rod 20 and the horizontal plane 25 through rod 13. Hereby the bendings caused by rods 13 and 20 are substantially independent of one another.

The structure according to FIG. 5 comprises two cavities accessible via openings 26, in which cavities the rods 13 and 21 are situated. During manufacture the frame 18 can be turned over temporarily in order to pour glue into the cavities for the purpose of gluing rods 13, 21 therein.

Attention is drawn to the fact that the cavity 9 according to FIG. 1 is placed at a distance from the neutral fibre of the profile 5. Rod 13 can thereby only be bent in an inclining plane, which assumes a position between the planes 24 and 25 drawn in FIG. 4.

Figure 7:
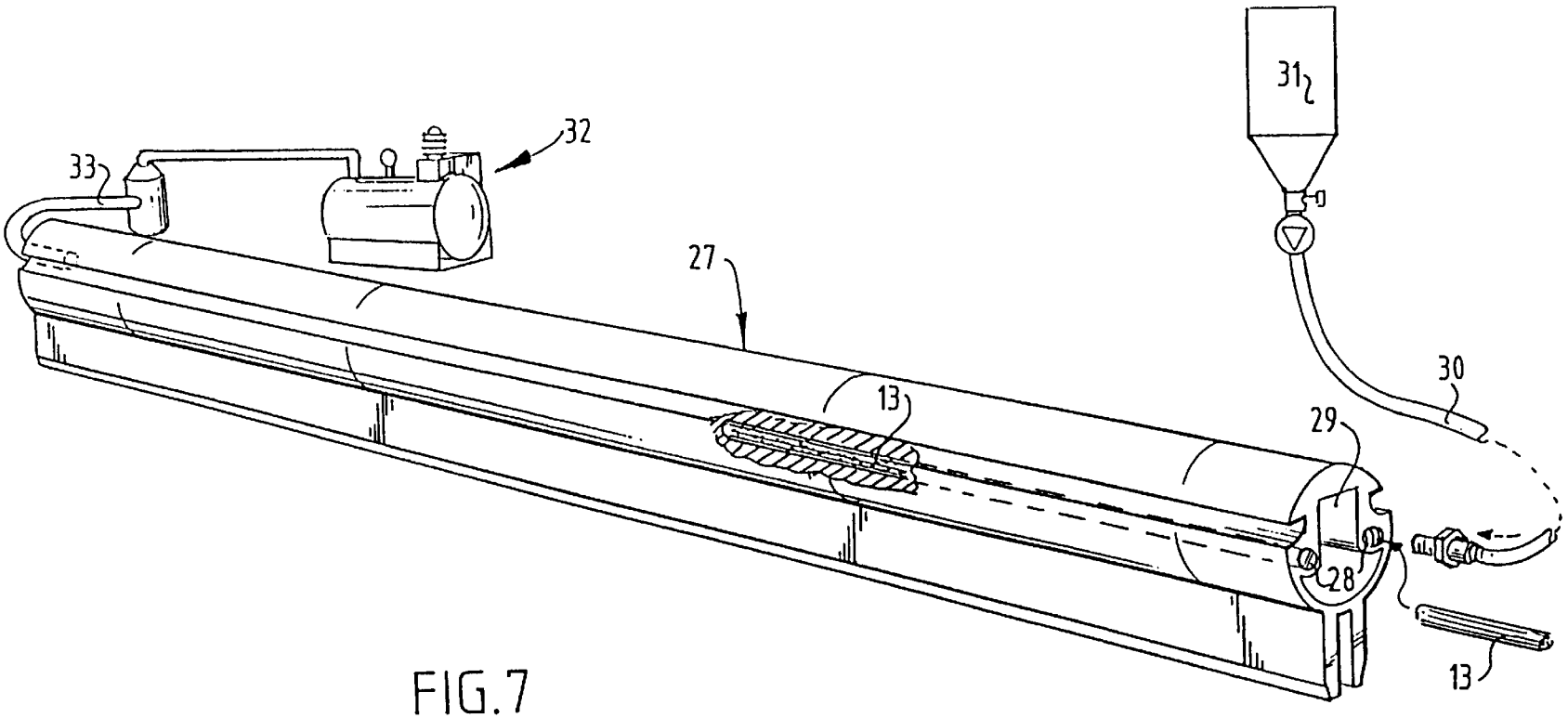
FIG. 7 is a partly broken away perspective view of a skate frame and device for gluing in a reinforcing rod.

FIG. 7 shows a profile 27 which bears a strong resemblance to the profile 18 according to FIG. 5, but differs therefrom in that the cavities 28 are separate from the central cavity 29. In this embodiment a carbon rod 13 is first arranged in a cavity 28, a glue reservoir 31 is subsequently connected via a conduit 30 for supplying glue into cavity 28, into which rod 13 is placed beforehand. Glue is subsequently drawn in by means of a suction pump 32, which is connected to the other end of cavity 28 by means of a conduit 33, such that the glue fills the interspace between the wall of cavity 28 and the rod 13. The glue is optionally cured by an increase in temperature. If desired, the open ends of cavities 28 can be covered with a plug.

Figure 8:
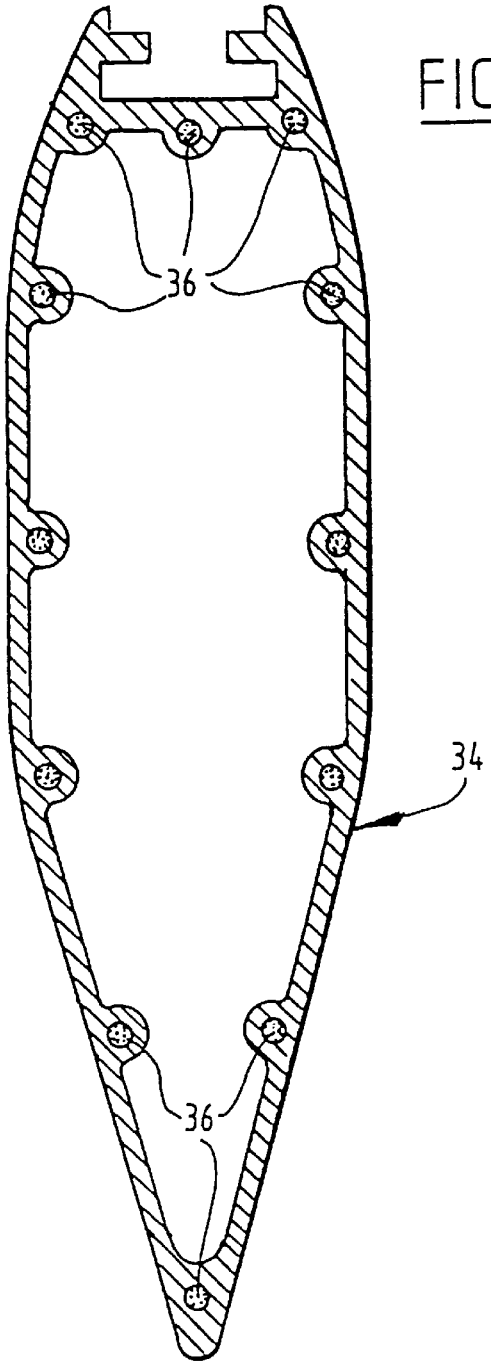
FIGS. 8 and 9 show cross sections through other examples of extrusion profiles with a plurality of reinforcing rods in accordance with the teaching of the invention.
Figure 9:
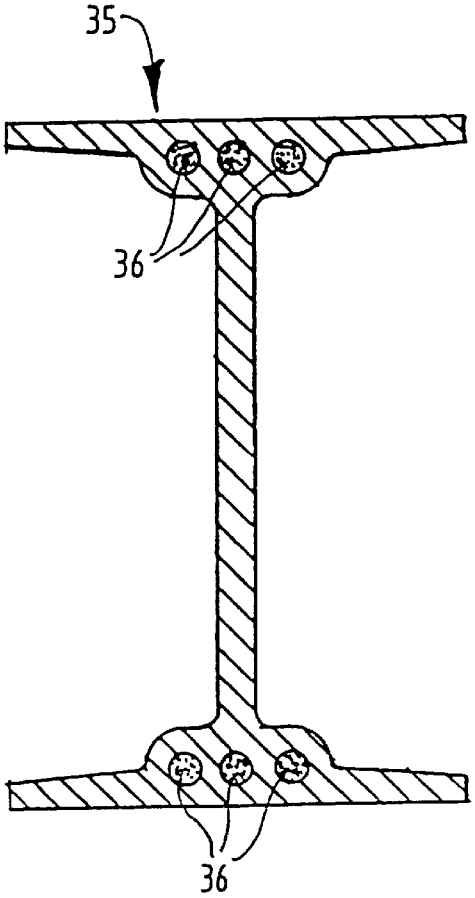

FIGS. 8 and 9 show cross sections through respective profiles 34 and 35. Profile 34 can for instance serve as sailing boat mast. Reinforcing rods are designated with reference numeral 36.

The profile 35 is an I-beam which is intended as construction element for building structures. These profiles 34, 35 can also be manufactured by extrusion from aluminium.

Figure 10:
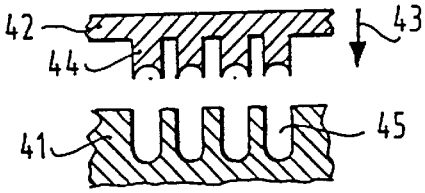
FIG. 10 shows a cross section through two coacting profiles for manufacturing a body according to the invention.

FIG. 10 shows two partially depicted profiles 41, 42 which can be moved toward one another as according to arrow 43 such that protrusions 44 of profile 42 are inserted into spaces 45 of profile 41 such that cylindrical channels result. Reinforcing rods are placed beforehand in the spaces 45. With suitable means, for instance glue, the profiles 41, 42 are held together such that the reinforcing rods (not shown) are connected to the obtained structure in force-transmitting manner.

Figure 11:
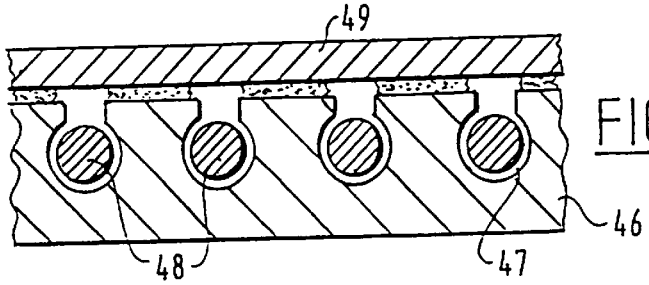
FIG. 11 shows a cross section through a variant.

FIG. 11 shows a variant in which an elongate body 46 has undercut recesses 47 in which reinforcing rods 48 are prearranged. The recesses 47 are subsequently covered by a plate 49. The profiles according to FIGS. 10 and 11 can be manufactured very suitably by means of pulltrusion. It is important to prevent corrosion between the carbon rod and the material of the relevant profile, in particular aluminium. A complete embedding and sealing relative to the environment can serve for this purpose.

Figure 12:
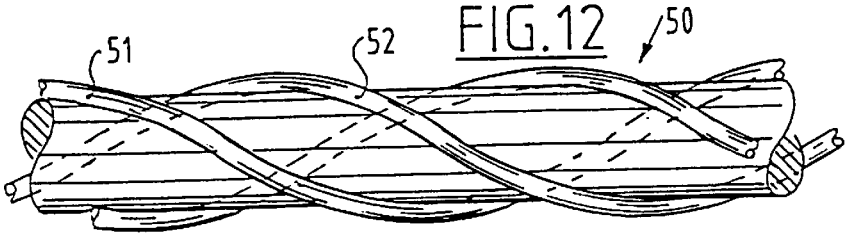
FIG. 12 is a partial side view of a drive shaft according to the invention with torsion- and bending-stiffness.

FIG. 12 shows a drive shaft 50 with a very slightly helical form. This helical form is obtained after extrusion of shaft 50 by for instance applying a heavy torsional stress to the initially straight-extruded, tubular drive shaft, whereby a plastic deformation occurs. The drive shaft provided beforehand with reinforcing rods 51, 52 thus obtains in this embodiment a greatly increased one-sided torsion stiffness. A two-sided increase in the torsion stiffness can also be envisaged by arranging reinforcing rods running crosswise. The described manner of manufacture cannot be applied here.

It can be of importance to use a glue for gluing in reinforcing rods which has a high resistance to creep stresses at an increased temperature. An increased resistance can be obtained by adding temperature resistant particles to the glue. These may be metal or ceramic particles. A glue with a high glass transition temperature also provides an increased resistance of the glue connection to creep. It is noted that creep or relaxation occurs in glues and matrix materials in the case of prolonged load at increased temperature.

An epoxy glue can be provided with so-called flexibilizers, whereby shock and peak loads can be absorbed better. In the case of an epoxy glue for instance an increased flexibility is obtained by adding slightly more hardener relative to the resin part than is prescribed for normal applications. The addition of fine rubber particles is also very effective in relation to the desired flexibility.

When reinforcing rods of glass fibre are used, these glass fibres can also serve for data transmission.

Glass can be cast into cavities in extrusion profiles as reinforcing material. In this manner a very good vacuum or pressure through-feed can also be realized.

Profiles can be applied wherein at least a number of cavities extending in longitudinal direction are used for other purposes, for instance data transport, liquid transport or gas transport.

Additional channels can if desired also be used for bringing a profile to and holding thereof at a determined temperature. Particularly in situations where excessively high temperatures can adversely affect the quality of the construction, cooling of an aluminium profile can be realized by causing coolant to flow through the relevant channels.

The internal surface of the longitudinally extending cavity can be pretreated to improve adhesion of an applied glue. The surface can for instance be treated with a solution of sodium hydroxide, potassium hydroxide or the like. These agents dissolve a small portion of the surface, thereby removing the oxide skin which is disadvantageous in obtaining a good adhesion. After pickling with such a caustic soda the surface is washed well with water and then dried. Gluing must take place relatively quickly after this pickling process in order to prevent renewed oxide formation. After the pickling the surface can also be passivated in the usual manner by for instance chrome-plating or anodizing.

By pickling the inner surface of the cavities with caustic soda the inner diameter of the cavity can also be increased. The enlargement obtained is dependent on the duration, concentration and temperature of the caustic soda. The glue gap (see FIG. 7) between the wall of the cavity and the reinforcing rod requires a value with close tolerance. The extrusion process for manufacturing an extruded aluminium profile cannot be performed well in respect of this close tolerance. The cavity can be widened in the described manner by pickling. When the cavities have mutually differing diameters, different pickling times can be prescribed per cavity in order to eventually obtain the nominal diameter everywhere.

Figure 13:
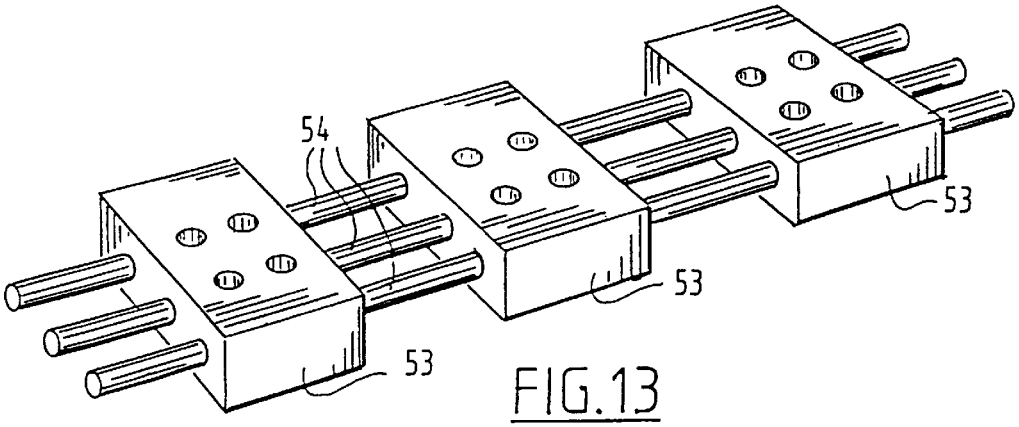
FIG. 13 is a schematic perspective view of an interrupted profile with continuous reinforcing rods.

FIG. 13 shows an interrupted profile consisting of blocks 53 through which three carbon reinforcing rods 54 extend continuously. In this embodiment blocks 53 can provide the desired positioning of the carbon rods 54 and can be used to discharge the forces to the environment. The application of the structure shown in FIG. 13 is for instance reinforcing existing structures under strain of bending, such as bridges and other frames, for instance the heavily loaded frames of transport means such as trucks.

Figure 14:
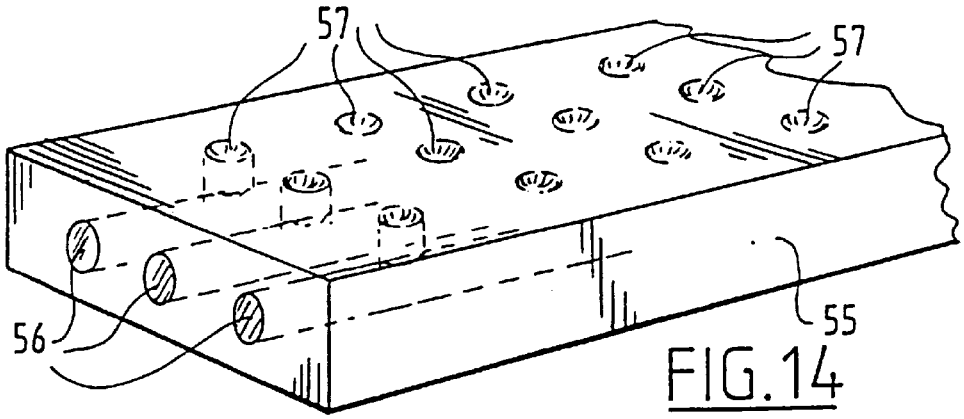
FIG. 14 is a schematic perspective partial view of a variant.

FIG. 14 shows a beam 55 in which three carbon rods 56 extend in longitudinal direction. Zones 57 pressed plastically inward are arranged from outside to fix the carbon rods 56.

Figure 15:
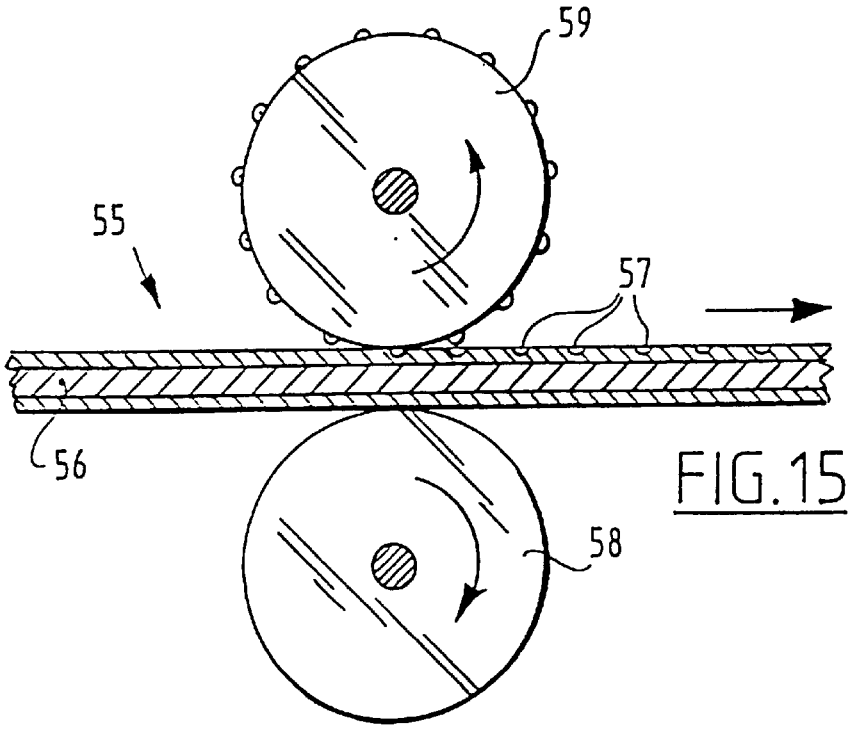
FIG. 15 shows a longitudinal cross sectional view of the embodiment according to FIG. 14 during production.

FIG. 15 shows the manner in which these plastic deformations can be arranged. The beam 55 is carried through the pinch between a non-profiled lower roller 58 and a profiled upper roller 59. The form of the profiling of roller 59 is transferred to the beam 55 in the form of the depressions 57.

Figure 16:
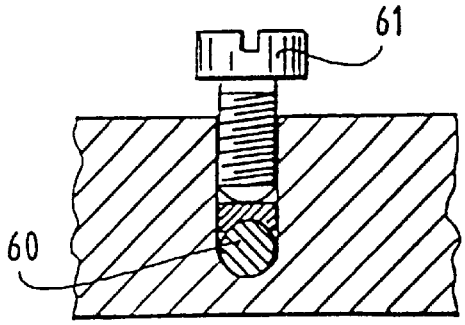
FIG. 16 shows a cross section through yet another embodiment.

FIG. 16 shows a variant in which a reinforcing rod 60 is pressed from outside by a screw 61.

Figure 17:
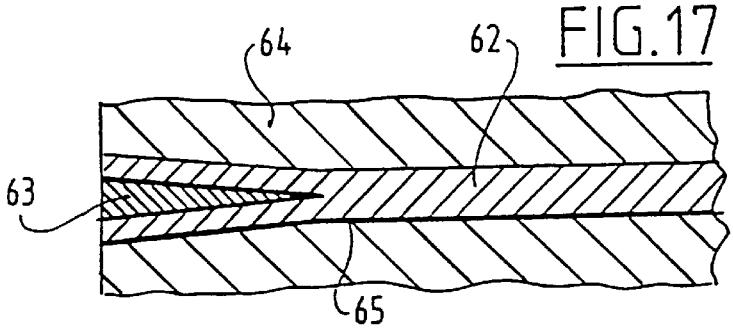
FIG. 17 shows a schematic longitudinal section through a variant.

FIG. 17 shows a variant in which the outer end of a carbon rod 62 is glued and clamped fixedly by means of a wedge 63. The elongate body 64 has for this purpose a channel 65 with a form widening toward the outside.

Figure 18:
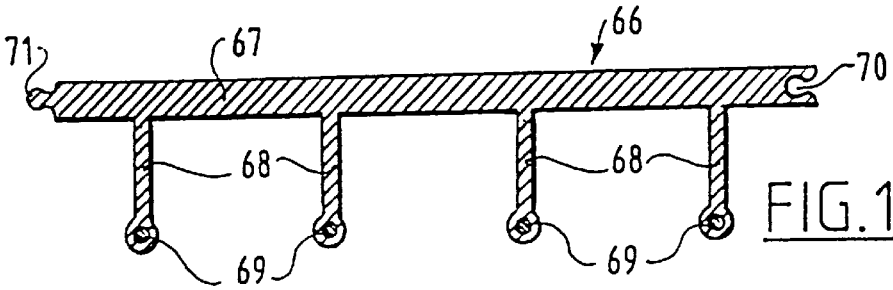
FIG. 18 shows a cross section through another variant.

FIG. 18 shows a floor part 66 which is embodied as aluminium extrusion part and comprises a flat upper plate 67 which is reinforced on its underside by ribs 68 which are reinforced on their bottom part with carbon rods 69. The plates 67 can be mutually coupled by means of undercut longitudinal recesses 70 and correspondingly formed longitudinal protrusions 71.

Figures 19A, 19B, 19C:
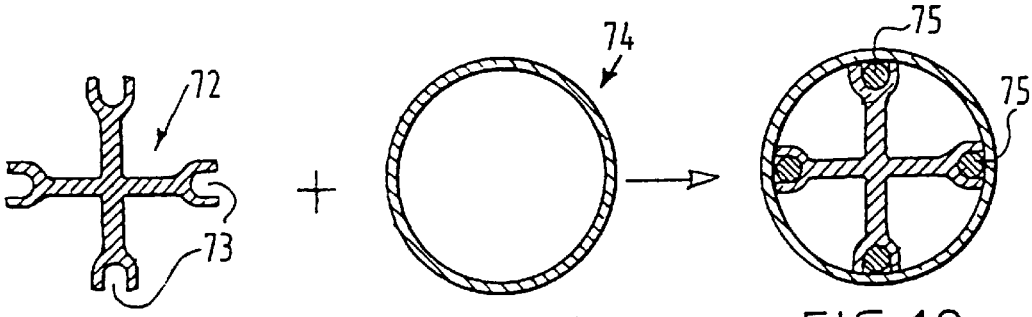
FIG. 19*a* shows a cross section through a reinforcing profile.
FIG. 19*b* shows a section through an aluminium tube for reinforcing.
FIG. 19*c* shows the assembly of the parts according to FIGS. 19*a* and 19*b* with reinforcing rods.

FIG. 19*a* shows a cross-shaped extruded aluminium profile 72 with cavities 73 for receiving reinforcing rods.

FIG. 19*b* shows an aluminium tube 74.

FIG. 19*c* shows the assembly of the reinforcing cross 72 and the aluminium tube 74, wherein carbon rods 75 are arranged in cavity 73 by means of glue. A unitary reinforced structure is hereby obtained.

Figure 20A:
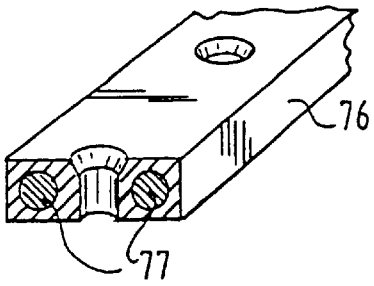
FIG. 20*a* shows a reinforcing body according to the invention.
Figure 20B:
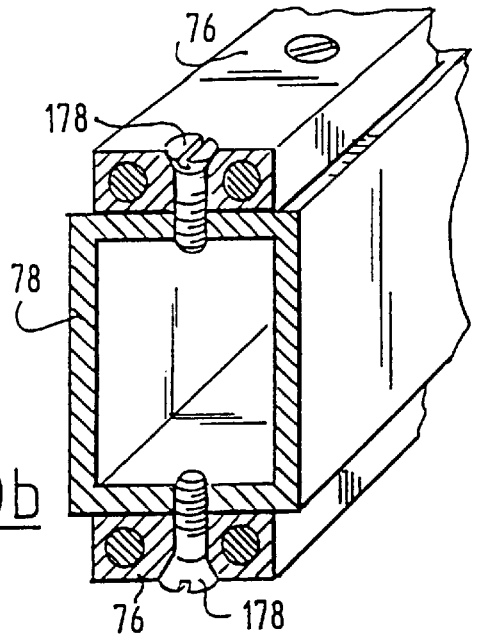
FIG. 20*b* shows a beam reinforced therewith.

FIG. 20*a* shows a reinforcing bar 76 into which carbon reinforcing rods 77 are glued. FIG. 20*b* shows that a beam 78 is reinforced with two such bars 76 which are connected thereto by screw means 178.

Figure 21A:
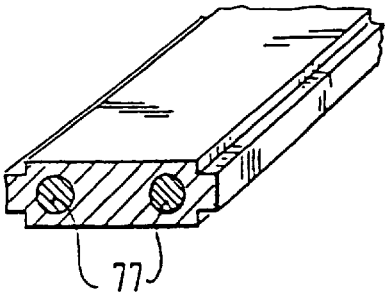
FIG. 21*a* shows an alternative reinforcing body.
Figure 21B:
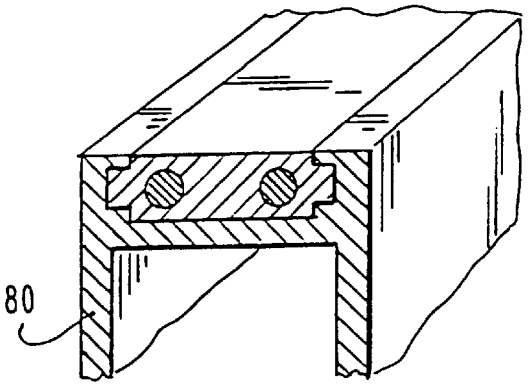
FIG. 21*b* shows an alternative beam reinforced therewith.

FIG. 21*a* shows an alternative reinforcing bar 79, which can be inserted in longitudinal direction in the manner shown in FIG. 21*b* in order to reinforce beam 80.

Figure 22:
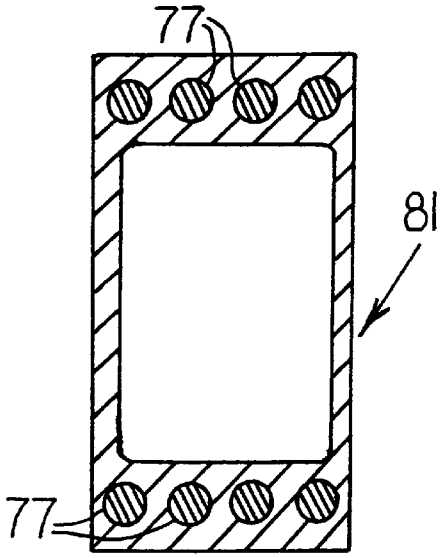
FIG. 22 shows a reinforced beam in cross section.

FIG. 22 shows a beam 81 which is reinforced with carbon reinforcing rods 77.

Figure 23:
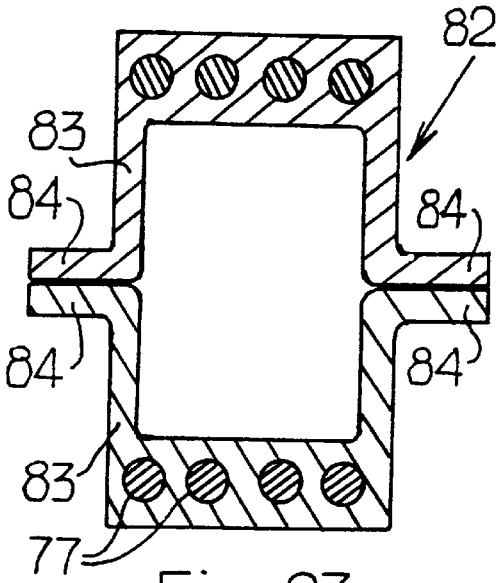
FIG. 23 shows an alternative reinforced beam in cross section.

FIG. 23 shows an alternative, wherein a beam 82 is assembled from two equal parts 83. The flanges 841 are mutually connected by for instance bolts (not shown).

Figure 24:
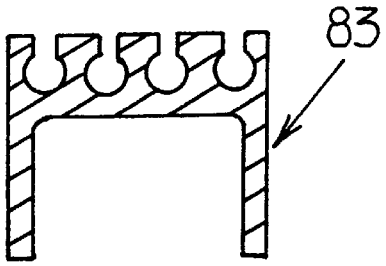
FIG. 24 shows yet another beam in cross section.

FIG. 24 shows a part of a beam 83 in accordance with the teaching of FIG. 11.

Figure 25:
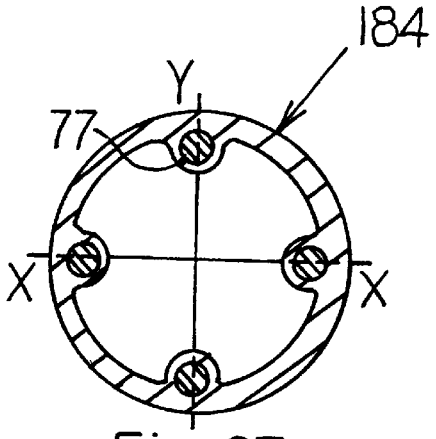
FIG. 25 shows a reinforced tube in cross section.

FIG. 25 shows a tube 184 reinforced with carbon rods 77. Due to the shown orientation and structure a very strong and light cycle frame can for instance be constructed with a high bending stiffness, in particular in the x and y direction.

Figure 26:
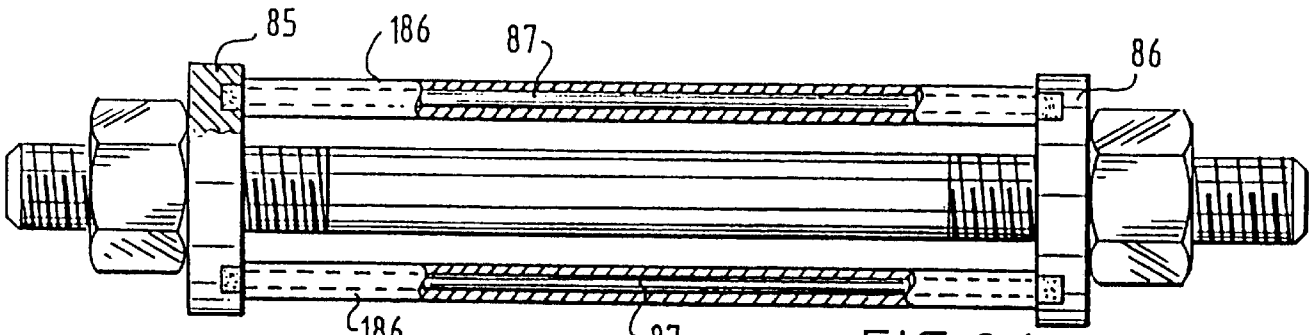
FIG. 26 is a schematic view of a device for manufacturing a fixedly biased structure according to the invention.

FIG. 26 shows schematically the manner in which a very light and very elongate structure with bending stiffness can be manufactured. Between two flanges 85, 86 a number of tubes 186 are positioned in pressure-resistant manner. Carbon rods 87 extend in these aluminium tubes. Non-cured epoxy glue is present in the space between the inner wall of a tube and the carbon rod. The flanges 85, 86 are urged toward one another by the shown screw construction, whereby a pressure stress with associated shortening results in tubes 186. The carbon rod 87 is arranged freely in the inner space and therefore not subjected to this pressure force and associated shortening. Curing of the epoxy glue is subsequently carried out, optionally with a certain increase in temperature. Due to the relaxation there now results a biased construction whereby a pressure force is maintained in the aluminium tube in combination with a corresponding tensile force in the carbon rod. Heating can take place as desired by hot air, hot water or electrical heating, for instance by passing an electric current through the carbon rods. An electric current can also be passed through the aluminium profile.

Figure 27:
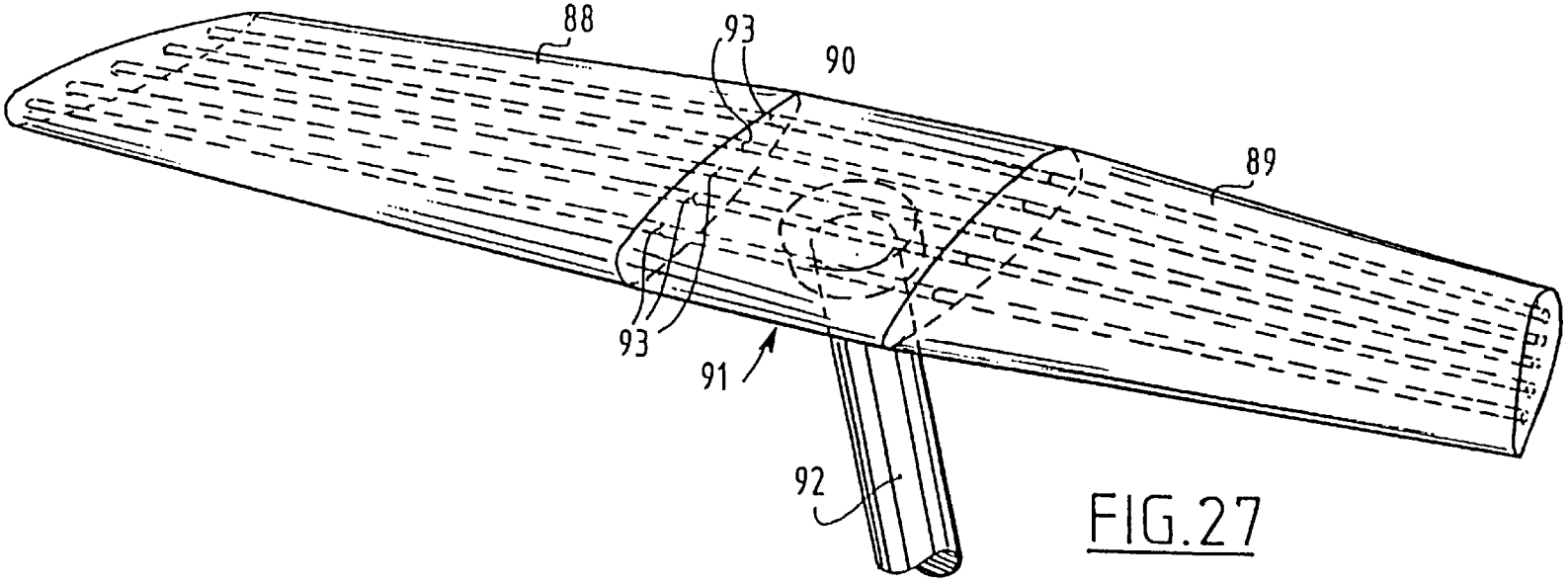
FIG. 27 is a schematic view through a set of windmill blades.

FIG. 27 shows two windmill blades 88, 89 which are placed at a mutual distance but which are mutually connected by means of continuous carbon rods 90, which also extend in the middle zone. A central block 91 serves for coupling to the blade shaft 92. The block 91 is provided with continuous holes 93 for passage of carbon rods 90.

The blades can for instance consist of aluminium or plastic.

The blades 88, 89 may also consist of mutually coupled parts. What is important is that the carbon reinforcing rods hold together the total structure and provide the necessary tensile strength.

Figure 29:
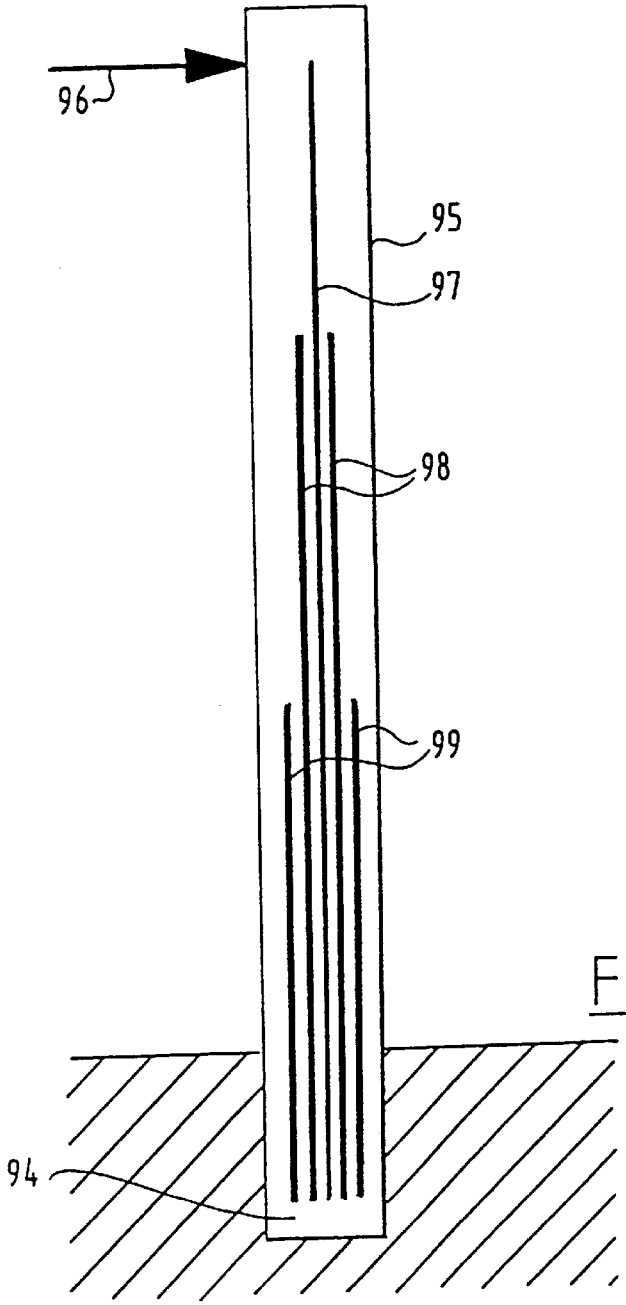
FIG. 29 is a schematic view of a vertical pole clamped on its underside and to be placed under strain of bending along its length.

FIG. 29 shows a pole 95 which is clamped on its underside 94 and which can be placed under strain of bending by means of forces designated symbolically with an arrow 96. What can be envisaged here is for instance a mast, for instance a flagpole, a ships mast, a lamppost or the like. Glued-in carbon reinforcing rods of different length are drawn symbolically. These rods 97, 98, 99 respectively provide a reinforcement such that the effective cross-sectional surface of the collective rods along the length of pole 95 varies by and large in accordance with the reinforcement desired at each axial position.

Figure 28:
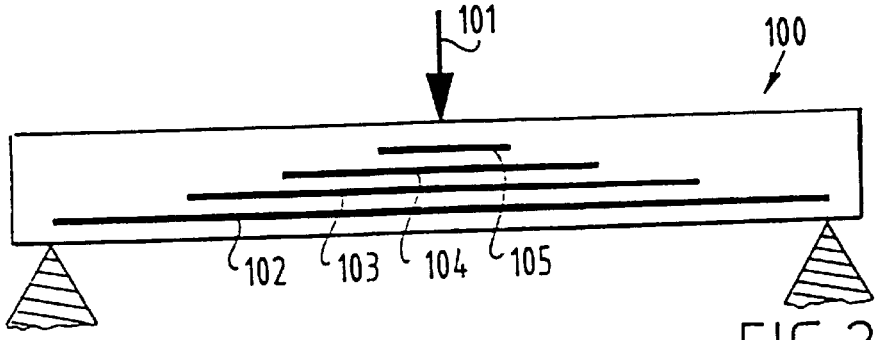
FIG. 28 is a schematic view of a beam to be placed-under strain of three-point bending.

FIG. 28 shows a beam 100 based on the same mechanical principle. The beam 100 supported on its ends is loaded in the middle with a bending force 101. Due to this three-point load the bending moment is zero at the ends of the beam and maximum in the middle. In accordance herewith four reinforcing rods are drawn symbolically, designated respectively from long to short with 102, 103, 104 and 105.

Figure 30:
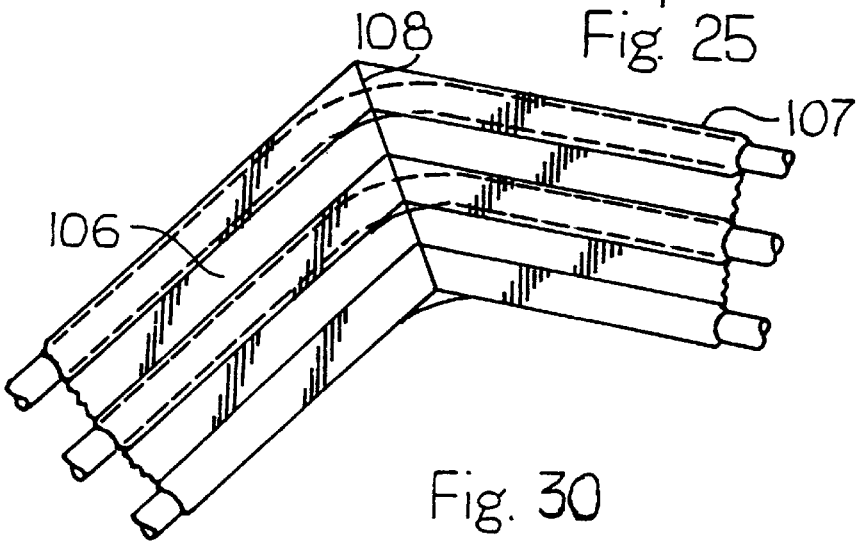
FIG. 30 shows an example of a composite body with reinforcing rods according to the invention.

FIG. 30 shows the coupling of profiles 106, 107 placed at a mutual angle. The outer surfaces extending transversely of the connecting seam 108 have a rounded and recessed form and are thus made suitable for gluing in of carbon reinforcing rods.

Figure 31:
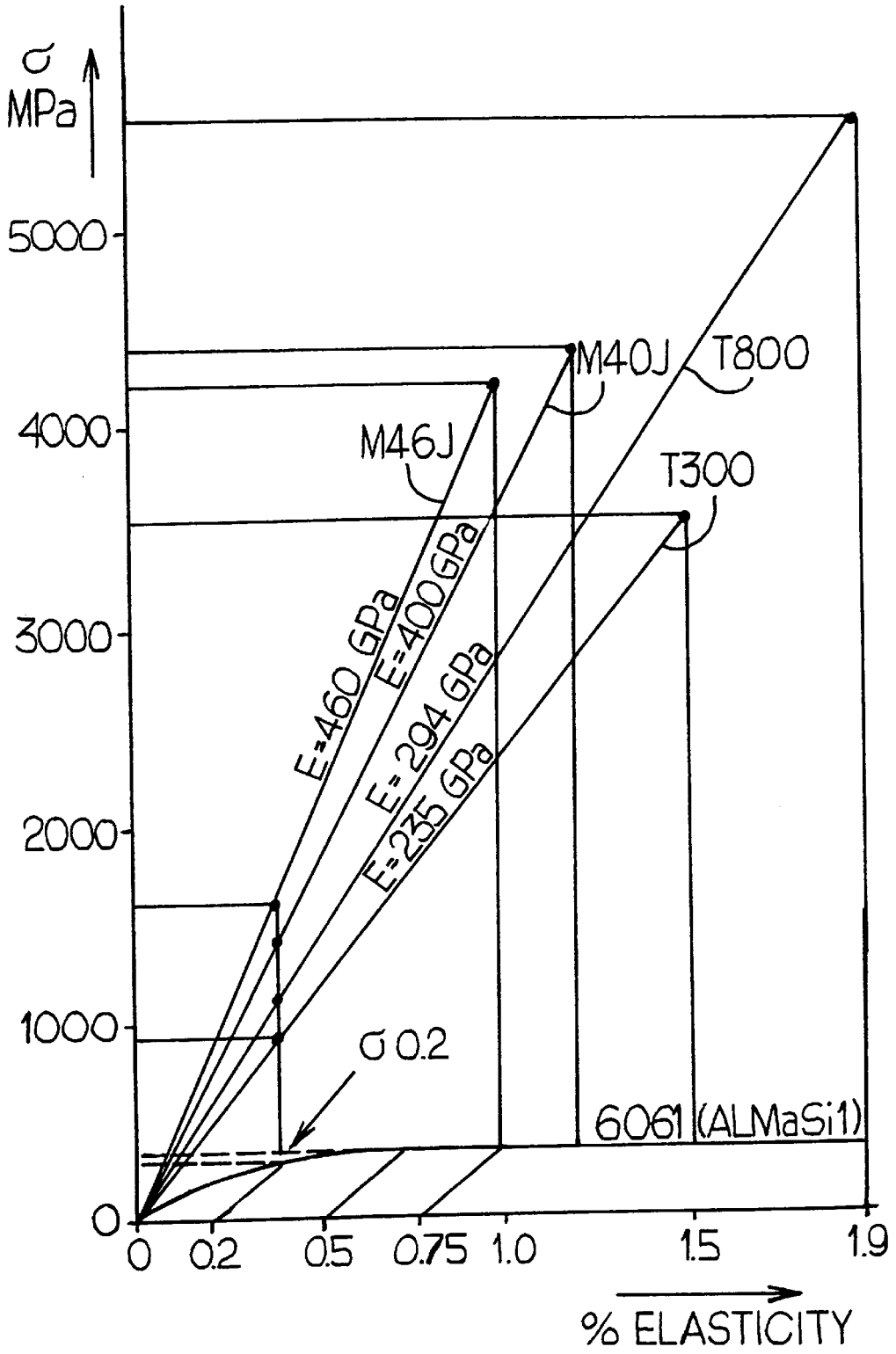
FIG. 31 shows a graphic representation of tension curves of determined carbon fibres and aluminium extrusion material for the purpose of elucidating an important application of the invention.

FIG. 31 shows a graphic representation of four different carbon fibres of the Toray brand and also of an aluminium extrusion material (AlMgSi 1; 6061).

This graphic representation shows that in particular carbon fibre material of the type T800 from the manufacturer Toray combines a very high limit of elasticity of 1.9% with a very high tensile strength, i.e. 5586 Mpa. The modulus of elasticity of this fibre material amounts to 294 Gpa.

The three other fibre types T300, M40J and M46J also have the same favourable properties, albeit to a slightly lesser degree. The application of such fibres as reinforcing rods of the type according to the invention in the automobile manufacturing industry is very suitable in view of the ever increasing demands being made in respect of crash consequences. It is important in crashes that the bodywork remains intact but nevertheless provides the possibility of withstanding the great forces which occur by means of plastic deformations (crush zones).

In normal use a profile reinforced with carbon can already give a considerable weight-saving with improved properties. The aluminium may absorb without any problem as much stretch as is required for the stretch of the reinforcing fibres to utilize the full strength of the fibre material. Full benefit can hereby be derived from the strength and the stretch possibilities of the carbon material. Reference is made in this respect to the graph of FIG. 31.

It is noted that the above mentioned manufacturer Toray also supplies even stronger carbon fibres, for instance of the type T1000. Fibres with a considerably lesser stiffness can also be used, such as the above mentioned glass fibres, aramid fibres or polyethylene fibres. The designer of such structures must then realize that higher demands are then made of the stretch possibilities of the aluminium.

The coefficient of expansion of carbon fibre material is smaller than that of aluminium. The coefficient of expansion of the plastic matrix is however considerably larger than that of aluminium. By now choosing a suitable ratio of the quantity of carbon fibres and the plastic matrix material, a coefficient of expansion can be obtained which is equivalent to that of aluminium. Due to this equivalence of the coefficient of expansion the glue is variably loaded in radial direction either not at all or to a negligible degree in the case of temperature fluctuations, which will result in a longer lifespan.

Other very strong materials can also be glued in, such as special aluminium and/or lithium alloys. Such materials are often difficult to extrude in complicated forms and the strength can often be increased by for instance cold deformation. Known in this respect is the so-called cold-drawn wire. Benefit can here also be derived from the equal coefficients of expansion.

What is claimed is:

1. An article of manufacture, comprising:

an elongate metal body of a chosen cross-sectional form, the body having at least one cavity of a chosen cross-sectional geometry extending substantially in a longitudinal direction; and a pre-manufactured elongate reinforcing rod having a bundle of longitudinally-extending, continuous fibers embedded in a plastic matrix, wherein the reinforcing rod is received in the at least one cavity connected to the body in a force transmitting manner and completely embedded and sealed in the at least one cavity.

2. The article of claim 1, wherein the reinforcing rod is connected to the body by glue.

3. The article of claim 2, wherein the glue has particles added thereto.

4. The article of claim 3, wherein the particles are temperature resistant.

5. The article of claim 3, wherein the particles are one of metal and ceramic.

6. The article of claim 3, wherein the particles are rubber particles.

7. The article of claim 2, wherein the glue is an epoxy glue.

8. The article of claim 2, wherein the glue has increased resistance to creep stresses at increased temperature.

9. The article of claim 2, wherein at least a portion of the cavity surface is treated to improve adhesion of the glue.

10. The article of claim 9, wherein the cavity surface is treated by one of pickling, passivating, etching, chromatizing, chrome-plating, anodizing, de-greasing and making oxide-free.

11. The article of claim 1, wherein at least one end of the reinforcing rod protrudes beyond the body.

12. The article of claim 1, wherein a further body is coupled to the body by the reinforcing rod extending through both the bodies.

13. The article of claim 11, wherein the body is an extruded aluminum beam.

14. The article of claim 1, wherein the reinforcing rod has a cross-sectional form configured to cooperate with the geometry of the cavity.

15. The article of claim 14, wherein the cross-sectional form of the reinforcing rod is circular.

16. The article of claim 1, wherein the reinforcing rod is connected to the body substantially along its entire outer surface.

17. The article of claim 1, wherein the at least one cavity in the body is formed between complementary components forming the body.

18. The article of claim 1, wherein the at least one cavity is partially open to the outside so as to form an open sided recess in which the reinforcing rod is positioned.

19. The article of claim 18, wherein the open sided recess is covered by a plate coextending with the body.

20. The article of claim 1, wherein the reinforcing rod fits into the cavity with a small clearance.

21. The article of claim 1, further including biasing means for holding the reinforcing rod under longitudinal bias.

22. The article of claim 21, wherein the longitudinal bias is adjustable.

23. The article of claim 22, wherein the biasing means includes screw means.

24. The article of claim 21, wherein the biasing means is adapted to exert a pressure force on the ends of the reinforcing rods.

25. The article of claim 21, wherein the cavity is positioned at a distance from a neutral fiber of the body.

26. The article of claim 1, wherein the body is formed as a skate frame for one of an ice skate and a roller skate.

27. The article of claim 26, wherein the skate frame has a longitudinal curvature.

28. The article of claim 27, wherein the longitudinal curvature is adjustable.

29. The article of claim 1, wherein the reinforcing rod is received in the at least one cavity under fixed bias.

30. The article of claim 1, wherein the reinforcing rod is made of metal.

31. The article of claim 30, wherein the metal is selected from the group consisting of steel, aluminum, lithium and aluminum alloy.

32. The article of claim 1, wherein the continuous fibers include carbon fibers.

33. The article of claim 32, wherein the carbon fibers have an elasticity limit of more than 1%, a tensile strength of more than 3 Gpa and an elasticity modulus of more than 180 Gpa.

34. The article of claim 33, wherein the carbon fibers are of the T800 type.

35. The article of claim 32, wherein a quantity of the carbon fibers and the plastic matrix is chosen in a ratio such that a coefficient of expansion is obtained which is substantially equivalent to that of the body.

36. The article of claim 1, wherein an effective cross-sectional surface of all of a plurality of reinforcing rods collectively along a length of the body varies in accordance with a locally desired reinforcement.

37. A method of forming an article of manufacture, comprising the steps of:

extruding an elongate metal body of a chosen cross-sectional form, the body having at least one cavity of a chosen cross-sectional geometry extending substantially in a longitudinal direction;

positioning an elongate reinforcing rod in the at least one cavity by co-transport with the extruded body; and drawing in glue to the cavity by a suction pump connected to an end of the cavity, wherein the reinforcing rod is connected to the body in a force transmitting manner and is completely embedded and sealed in the at least one cavity.

38. The method of claim 37, further including the step of allowing the glue to harden with the body in a pressed condition.

39. The method of claim 37, further including the step of allowing the glue to harden with the reinforcing rod in a tensioned condition.

40. The method of claim 37, further including the step of curing the glue at an increased temperature.

41. The method of claim 40, wherein the temperature is increased and the glue is cured by the step of passing an electric current through the reinforcing rod.

42. An article of manufacture, comprising:

an elongate metal body of a chosen cross-sectional form, the body having at least one cavity of a chosen cross-sectional geometry extending substantially in a longitudinal direction; and a pre-manufactured elongate reinforcing rod having a bundle of longitudinally-extending, continuous fibers embedded in a plastic matrix received in the at least one cavity, wherein the reinforcing rod is connected to the body in a force transmitting manner, and the rod is connected to the body substantially along its entire outer surface.

* * * * *